US007410448B2

(12) United States Patent
Cohen

(10) Patent No.: US 7,410,448 B2
(45) Date of Patent: Aug. 12, 2008

(54) EXERCISE BELT FOR STOMACH MUSCLES

(76) Inventor: Shmuel Cohen, 4 Hachoshen Street, Mevasseret Zion (IL) 90805

( * ) Notice: Subject to any disclaimer, the term of this patent is extended or adjusted under 35 U.S.C. 154(b) by 0 days.

(21) Appl. No.: 11/461,528

(22) Filed: Aug. 1, 2006

(65) Prior Publication Data

US 2007/0066462 A1 Mar. 22, 2007

(30) Foreign Application Priority Data

Aug. 4, 2005 (IL) ..... 170081

(51) Int. Cl.
*A63B 21/00* (2006.01)
*A61H 7/00* (2006.01)

(52) U.S. Cl. ..... 482/4; 482/1; 601/152

(58) Field of Classification Search ..... 482/1–9, 482/140, 900–902; 601/49, 152, 61, 71; 602/19; 340/571, 572.1, 572.4, 573.7
See application file for complete search history.

(56) References Cited

U.S. PATENT DOCUMENTS

RE35,940 E * 10/1998 Heinz et al. ..... 602/19
6,146,312 A * 11/2000 Sclichter ..... 482/4
2003/0073940 A1* 4/2003 Zicherman ..... 601/49

* cited by examiner

*Primary Examiner*—Glenn Richman
(74) *Attorney, Agent, or Firm*—Baker Botts L.L.P.

(57) ABSTRACT

The present invention provides a mechanical device for stimulating stomach muscles, comprising a belt-like element sized to be worn with a section thereof adjacent the stomach muscles of the wearer, the belt being associated with a motor and a power element for driving the motor, the motor being mechanically linked to means for intermittently tensioning at least the section to repeatedly intermittently press against the stomach muscles of the wearer in order to stimulate the muscles to contract as a reaction and in anticipation of the repeated intermittent contact.

7 Claims, 3 Drawing Sheets

EXERCISE BELT FOR STOMACH MUSCLES

The present invention relates to exercise equipment.

More particularly, the invention provides a mobile belt-like device which intermittently exerts and releases external pressure on the stomach and its muscles.

Possibly because of car use, TV viewing and the consumption of junk food there is a well-known tendency in developed countries towards a population that is increasingly becoming overweight and obese. Many are aware of the health dangers therein, mainly but not only heart failure, and subject themselves to diets and/or more exercise. While exercise can be performed without any equipment, nevertheless a large market has developed for exercising machinery such as stationery bicycles, treadmills, rowing machines, step-climbing machines and others.

The disadvantages of such machinery is that such equipment takes up considerable floor space, is bulky even when folded when not in use, is visually intrusive and a user thereof loses time which might be needed for other activities. Furthermore the devices are costly.

Yet a further problem is that many people do not want to be seen using such machines as some observers might consider this to be undignified and an admission of weakness, heart problems or excess body weight.

Portable devices which can be used in a more discrete manner are also known, for exercising particular body parts such as the feet, hands or fingers. Some of the exercise machines discussed previously also exercise the stomach muscles, yet do not meet the requirements of most overweight people for reasons explained above.

A search for prior art patents referring to a device of the type disclosed in the present invention was fruitless. Prior art patents (for example U.S. Pat. Nos. 6,416,002; 6,681,914 and 6,743,131) do refer to the subject of belt tightening, but refer to industrial or safety belts. The belts tightening devices seen in these and further patents do not seem to be applicable to the belt tightening mechanism which is an important part of the present invention.

It is therefore one of the objects of the present invention to obviate the disadvantages of prior art stomach muscle exercising machines and to provide a portable device which can be hidden by outer clothing while in use, and also allows the user to continue with some other activity while exercising.

It is a further object of the present invention to provide a device which can be used while the user is at home, and while traveling in a vehicle and while being in a location where no external power source is available.

The present invention achieves the above objectives by providing a mechanical device for stimulating stomach muscles, comprising a belt-like element sized to be worn with a section thereof adjacent the stomach muscles of the wearer, said belt being associated with a motor and a power element for driving said motor, said motor being mechanically linked to means for intermittently tensioning at least said section to repeatedly intermittently press against the stomach muscles of the wearer in order to stimulate said muscles to contract as a reaction and in anticipation of said repeated intermittent contact.

In a preferred embodiment of the present invention there is provided a mechanical device for stimulating stomach muscles wherein said power means is a portable battery attached to said belt-like element.

In another preferred embodiment of the present invention there is provided a mechanical device for stimulating stomach muscles wherein said belt is provided with further segments having a plurality of spaced-apart sequential apertures, and said motor is attached to a sprocket wheel positioned to engage said sequential apertures provided in said further segments of said belt, the arrangement being such that said belt is repeatedly, intermittently displaceable between a first relaxed position and a second tensioned position by repeated clockwise and counter-clockwise rotation of said sprocket wheel.

In a further preferred embodiment of the present invention there is provided a mechanical device for stimulating stomach muscles further comprising control means for adjusting the timing and the extent of said clockwise and counter-clockwise rotation of said sprocket wheel.

In a further preferred embodiment of the present invention there is provided a mechanical device for stimulating stomach muscles wherein said clockwise rotation of said sprocket wheel tightens said belt and wherein a release clutch allows pressure of the stomach muscles of the user on said belt to return said belt to its pre-tightened position on release of a clutch disposed between said sprocket and said motor.

In yet a further preferred embodiment of the present invention there is provided a mechanical device for stimulating stomach muscles wherein said portable battery comprises a plurality of batteries as used in portable radio telephones.

In another preferred embodiment of the present invention there is provided a mechanical device for stimulating stomach muscles wherein a connector is provided for the supply of power from a battery of a vehicle.

In a most preferred embodiment of the present invention there is provided a mechanical device for stimulating stomach muscles as hereinbefore described wherein a connector is provided for the supply of power from a standard residential power socket.

It will thus be realized that the novel device of the present invention allows the user to exercise while walking in the street, while driving or being driven in a car and of course in the office and home environment. The device is unobtrusive and portable, and in relation to standard exercise machines the first cost is low enough to appeal to a wider population.

The invention will now be described in connection with certain preferred embodiments with reference to the following illustrative figures so that it may be more fully understood.

With specific reference now to the figures in detail, it is stressed that the particulars shown are by way of example and for purposes of illustrative discussion of the preferred embodiments of the present invention only and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

Figure 3A:
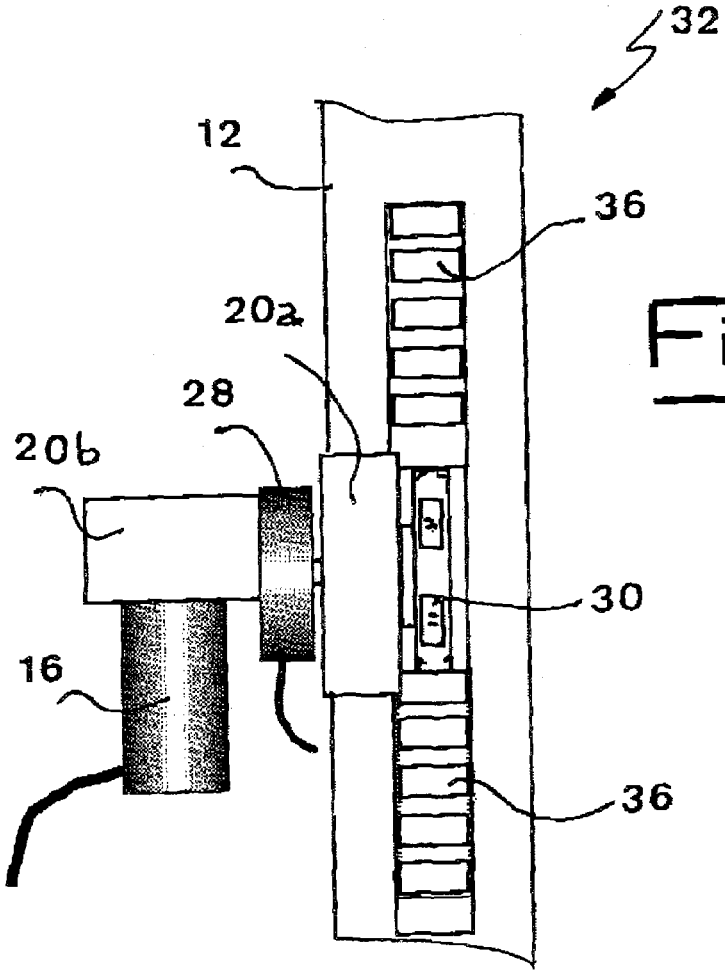
Figure 3B:
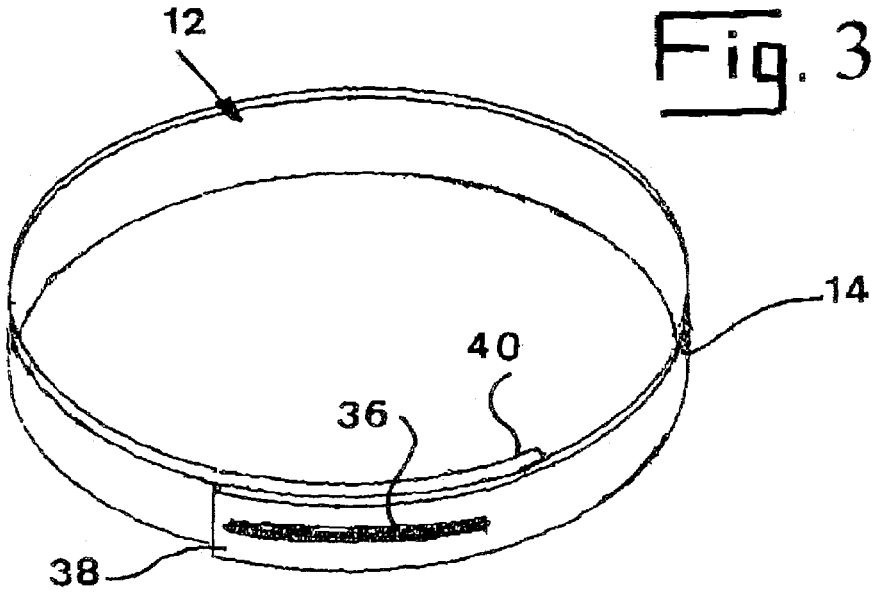
Figure 4:
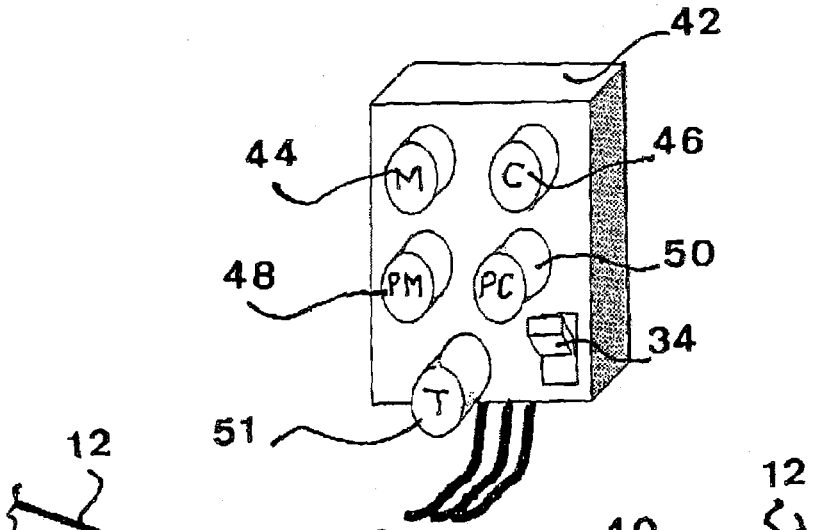
Figure 5:
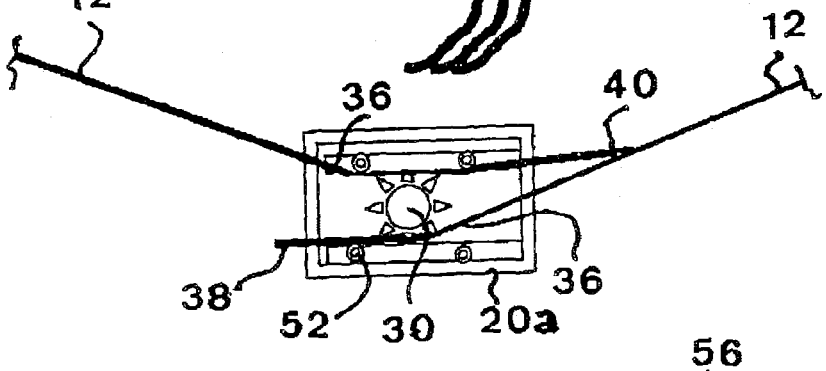
Figure 6:
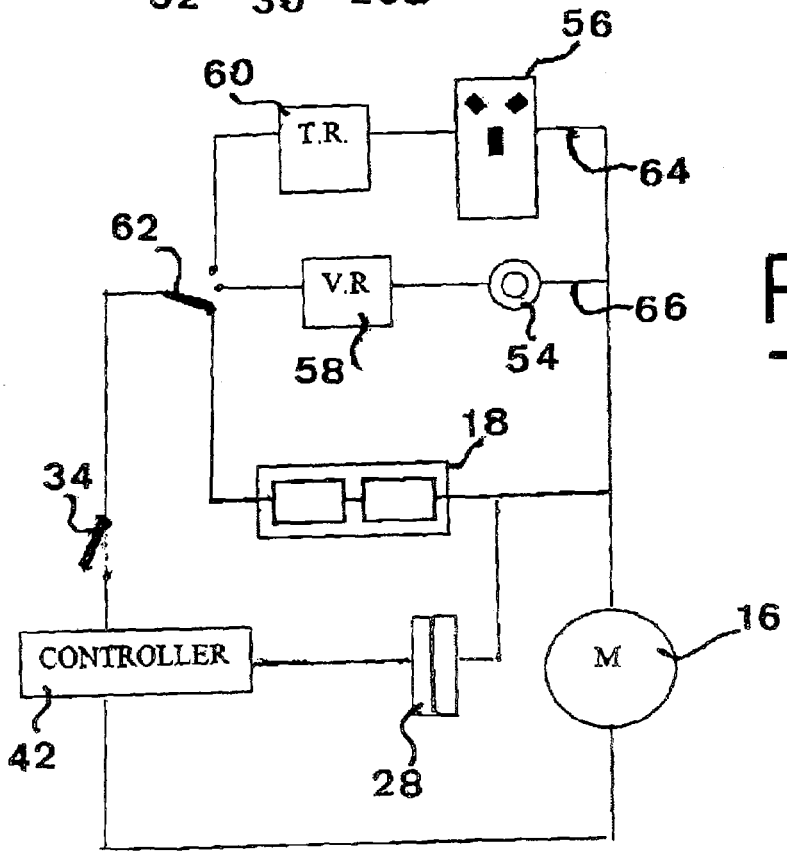

FIG. 3*a* is a side view of a second embodiment,

FIG. 3*b* is a perspective view of the belt;

FIG. 4 is a perspective view of a controller providing manual override and control to the user;

FIG. 5 is a plan view looking onto the sprocket wheel and the belt edges; and FIG. 6 is a an electric circuit diagram for the embodiment seen in FIG. 3*a*.

Figure 1:
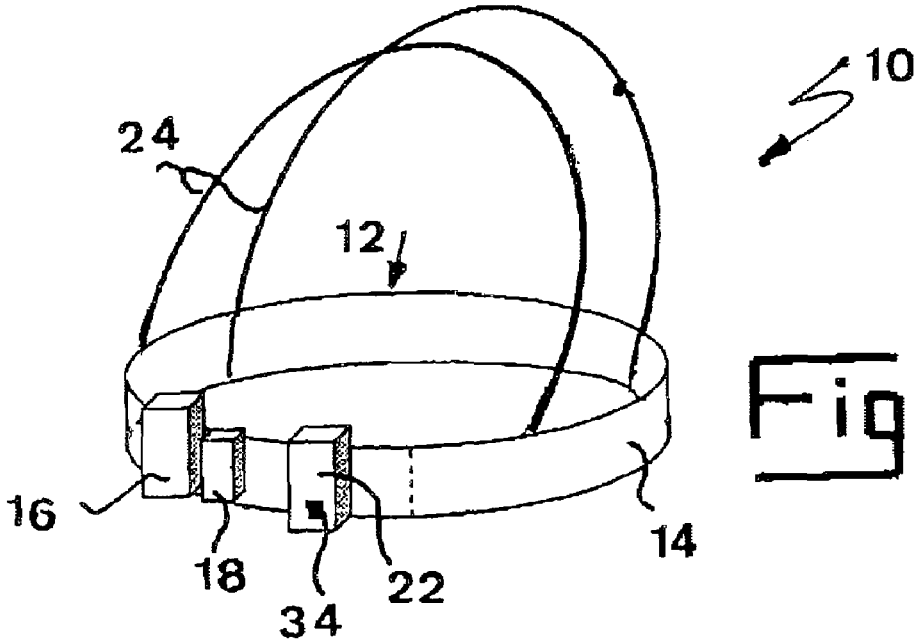
FIG. 1 is a non-detailed perspective view of a preferred embodiment of the device according to the invention.

There is seen in non-detailed form in FIG. 1 a mechanical device 10 for activating stomach muscles.

A belt-like element 12 is sized to be worn with a section thereof 14 adjacent the stomach muscles of the wearer.

The belt 12 can suitably be made of a low-friction flexible thermoplastic, typically polyester. Suitable dimensions are about 5 cm wide, and about 2 mm thick.

The belt carries a miniature electric motor 16, as well as a portable power source 18 for driving the motor 16.

The motor 16 is mechanically linked to speed reduction means 20, one embodiment of which will be seen and described with reference to FIG. 3*a*. The speed reduction ratio required is typically in the range 80 to 140:1.

The motor 16 is controlled by a controller 22 for intermittently tensioning the belt 12 so that the sector 14 repeatedly and intermittently presses against the stomach muscles of the wearer. Such pressure stimulates the muscles to contract as a reaction to and in anticipation of the repeated intermittent contact.

The belt closure force applied by the motor 16 and its associated mechanism is about 20N. Belt stretch when this force is applied is less than 1 cm. As will be seen in FIG. 5, the normal form of operation is that clockwise rotation of a sprocket wheel 30 as driven by the motor 16 and gearing 20 tightens the belt 12 in about 2 seconds.

Means are provided to retain the belt 12 in its correct position around the user. The diagram shows shoulder straps 24 which can be used for this purpose. Depending on individual preferences, support can be provided by other means such as clips engaging the normal trouser belt, or textile loops added to the clothing of the user.

With regard to the rest of the figures, similar reference numerals have been used to identify similar parts.

Figure 2:
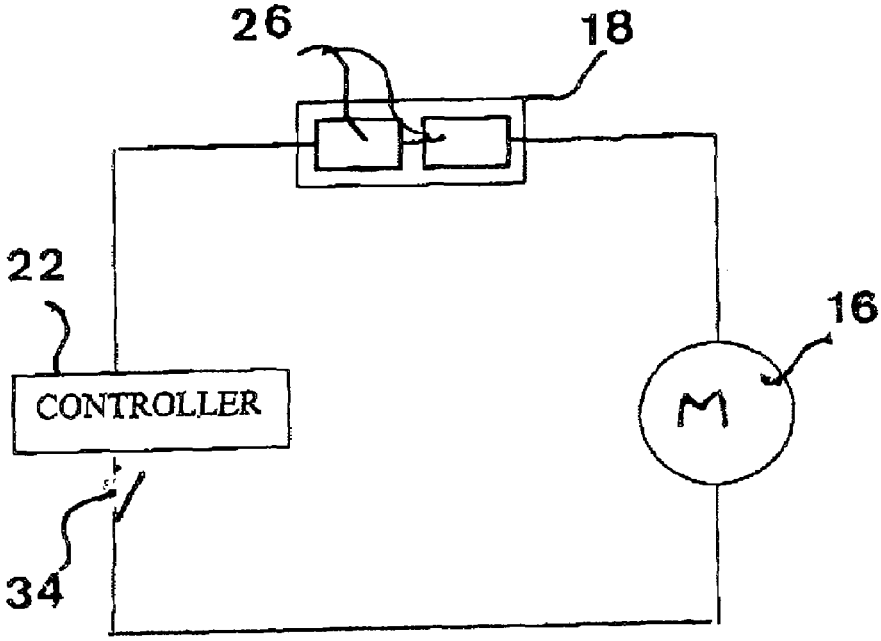
FIG. 2 is an electric circuit diagram for this embodiment.

Referring now to FIG. 2, there is seen the electrical circuit of the device 10 described with reference to FIG. 1. for stimulating stomach muscles. The miniature motor 16 driving the belt tightening mechanism is powered by a multi-cell 26 portable battery 18 and connected thereto through the controller 22. The battery 18 is separately supported by the belt 12, as seen in FIG. 1, but could be attached to the body of the motor 16 and its speed reduction gearing 20.

Preferably the portable battery 18 comprises 2 cells 26 of the type used in portable radio telephones. The cell-phone battery referred to here may itself comprise multiple cells, but for the purpose of the present description this battery will be referred to as a cell 26. Due to mass production, cells 26 are reliable and available at moderate cost, and have the high power density needed for powering any personally-carried article.

The following is an example of the battery 18:

Cell voltage: 3.6 volt, as used on personal radio telephones
No. of cells: 2, arranged in series
Battery voltage: 7.2
Battery current: 0.35-0.5 A
Battery power: 2.5 W
Cell Power density: 150 Wh/kg
Battery total weight: 170 gram
Operating time before recharge: about 8 hours.

A second example of a suitable battery 18:

Cell voltage: 3.6
No. of cells: 2, arranged in parallel
Battery voltage: 3.6
Battery current: 0.9 A approx
Battery power: 3 W
Power density: 150 Wh/kg
Battery total weight: 170 gram
Operating time before recharge: about 7 hours The following is an example of a suitable miniature motor 12:

Type: Reversible DC miniature
Output power, through gearing: 0.22 W
Motor speed under load: 5000 rpm
Motor current: 0.8 A
Motor voltage: 3.6 V
Motor power before gearing: about 2.9 W
Motor no-load speed: 7000 rpm
Motor weight without speed reducer: about 30 gram The controller 22 in the present embodiment is factory-set to provide repeated intermittent motor-battery forward and reverse connection. An on-off switch 34 is provided externally. During pause periods the motor 16 is not powered and yet belt tension is retained because the high ratio gearing 20*b* cannot be reverse-driven when the motor 16 is stationary.

Turning now to FIG. 3*a* there are illustrated essential features of a second embodiment of the device 32, having a different method of releasing belt tension.

An electro-magnetic powder clutch 28 is disposed between two sections 20*a*, 20*b* of the speed reducing gearing. The gearing section 20*a* contains spur gears and provides a speed reduction of about 3-4:1, while the second portion 20*b* of the speed reducing gearing contains a worm gear and has a ratio of about 25-40:1.

After a short interval the controller 42, seen in FIG. 6, releases the clutch 28 disposed between the sprocket wheel 30 and the motor 16, whereafter pressure of the stomach muscles of the user on the belt 12 returns the belt 12 to its pre-tightened position while revolving the sprocket 30 and the gearing section 20*a* to which it is connected in an anti-clockwise direction.

It should be noted that operation of the clutch 28 is effected without needing increased power output from the battery 18, because the clutch 28 and the motor 16 are never actuated at the same time.

Electric control of the motor 16 is thus simplified, as the motor 16 need not be periodically reversed. In the present embodiment the motor 16 provided is used only for belt tightening, whereas belt release is by the stomach muscles of the user as described.

The belt 12 seen in FIG. 3*b* is the same for both embodiments. The belt 12 is sufficiently long to envelope its user with substantial overlap, and has a total length of approximately 1-2 meters. Provided near the overlapping belt ends 38, 40 is a segment having a plurality of spaced-apart sequential apertures 36. These are preferably made of a metal to ensure a long operating life. The sequential apertures 36 are engaged by the sprocket wheel 30, the arrangement being such that the belt is repeatedly, intermittently displaced between a first relaxed position and a second tensioned position by repeated clockwise rotation of the sprocket wheel 30.

Seen in FIG. 4 is an electronic controller 42 suitable for the embodiment 32 seen in FIG. 3*a*. The controller 42, although normally working automatically, has a user control 44 for the motor, and a second control 46 for the clutch. Further controls 48 and 50 relate to the duration of operation. The lowest control 51 sets the timing, i.e. the cycle frequency. Thus the device allows manual override control, and an on-off switch 34 useful to prevent power wastage.

Referring now to FIG. 5, there is depicted the motor-driven sprocket wheel 30 simultaneously engaging both strips of the apertures 38, one of which is visible in FIG. 3*b*. Small rollers 52 are seen which ensure that the sprocket wheel 30 maintains contact with the belt 12 and remains engaged to both sets of spaced-apart sequential apertures 36 seen in FIGS. 3*a* and *b*.

In an alternative embodiment (not shown) plastic slide pads are used for this purpose in place of the rollers 52.

FIG. 6 is a diagram of an electric circuit suitable for the device 32 seen in FIG. 3*a*.

The user of the device may select any of three power sources:

a. the portable battery 18;

b. a vehicle, for example the cigarette lighter 54 of a car; or c. a standard residential power socket 56.

For option b) a voltage regulator 58 is provided to reduce or boost the voltage to the same voltage level as produced by the battery 18. For option c) a transformer/rectifier unit 60 is provided to reduce the voltage and convert to DC power, also to the same voltage level as produced by the battery 18.

Selection can be effected by a selector switch 62 or simply by inserting/removing one of the two connector cords 64 and 66 which will be offered to users when purchasing the device.

It will be evident to those skilled in the art that the invention is not limited to the details of the foregoing illustrative embodiments and that the present invention may be embodied in other specific forms without departing from the spirit or essential attributes thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. A mechanical device for stimulating stomach muscles, comprising a belt-like element sized to be worn with a section thereof adjacent the stomach muscles of the wearer, said belt being associated with a motor and a power element for driving said motor, said motor being mechanically linked to means for intermittently tensioning at least said section to repeatedly intermittently press against the stomach muscles of the wearer in order to stimulate said muscles to contract as a reaction and in anticipation of said repeated intermittent contact, wherein said belt is provided with further segments having a plurality of spaced-apart sequential apertures, and said motor is attached to a sprocket wheel positioned to engage said sequential apertures provided in said further segments of said belt, the arrangement being such that said belt is repeatedly, intermittently displaceable between a first relaxed position and a second tensioned position by repeated clockwise and counter-clockwise rotation of said sprocket wheel.

2. A mechanical device for stimulating stomach muscles according to claim 1, wherein said power means is a portable battery attached to said belt-like element.

3. A mechanical device for stimulating stomach muscles according to claim 1, further comprising control means for adjusting the timing and the extent of said clockwise and counter-clockwise rotation of said sprocket wheel.

4. A mechanical device for stimulating stomach muscles according to claim 1, wherein said clockwise rotation of said sprocket wheel tightens said belt and wherein a release clutch allows pressure of the stomach muscles of the user on said belt to return said belt to its pre-tightened position on release of a clutch disposed between said sprocket and said motor.

5. A mechanical device for stimulating stomach muscles according to claim 2, wherein said portable battery comprises a plurality of batteries as used in portable radio telephones.

6. A mechanical device for stimulating stomach muscles according to claim 1, wherein a connector is provided for the supply of power from the battery of a vehicle.

7. A mechanical device for stimulating stomach muscles according to claim 1, wherein a connector is provided for the supply of power from a standard residential power socket.

* * * * *